US005559590A

United States Patent [19]

Arai et al.

[11] Patent Number: 5,559,590

[45] Date of Patent: Sep. 24, 1996

[54] IMAGE FORMING APPARATUS WHICH CLEANS A TRANSFER BELT BY APPLYING A BIAS VOLTAGE

[75] Inventors: Makoto Arai, Tokyo; Norimasa Sohmiya; Masakuni Konja, both of Souka; Satoshi Takano, Tokyo, all of Japan

[73] Assignee: Ricoh Company, Ltd., Tokyo, Japan

[21] Appl. No.: 373,428

[22] Filed: Jan. 17, 1995

[30] Foreign Application Priority Data

Jan. 19, 1994 [JP] Japan ..... 6-003992
Dec. 28, 1994 [JP] Japan ..... 6-328848

[51] Int. Cl.[6] ..... G03G 15/14

[52] U.S. Cl. ..... 355/271; 355/296

[58] Field of Search ..... 355/271, 272, 355/273, 274, 276, 275, 296; 430/126

[56] References Cited

U.S. PATENT DOCUMENTS

| | | | |
|---|---|---|---|
| 5,140,375 | 8/1992 | Shido et al. | 355/272 |
| 5,153,653 | 10/1992 | Fuma et al. | 355/275 |
| 5,172,173 | 12/1992 | Goto et al. | 355/275 |
| 5,182,602 | 1/1993 | Kakita et al. | 355/271 |
| 5,182,604 | 1/1993 | Asai | 355/273 |
| 5,198,863 | 3/1993 | Goto et al. | 355/274 |
| 5,253,022 | 10/1993 | Takeuchi et al. | 355/274 |
| 5,276,491 | 1/1994 | Fuma et al. | 355/275 |
| 5,291,253 | 3/1994 | Kumasake et al. | 355/275 |
| 5,335,052 | 8/1994 | Sato et al. | 355/271 |
| 5,426,485 | 6/1995 | Fujita et al. | 355/271 X |

FOREIGN PATENT DOCUMENTS

| | | |
|---|---|---|
| 3908488 | 9/1989 | Germany . |
| 4204470 | 8/1992 | Germany . |
| 4305686 | 8/1993 | Germany . |
| 3-69978 | 3/1991 | Japan . |
| 3-186876 | 8/1991 | Japan . |
| 4-209145 | 7/1992 | Japan . |
| 4-350860 | 12/1992 | Japan . |
| 5-265333 | 10/1993 | Japan . |

*Primary Examiner*—R. L. Moses
*Attorney, Agent, or Firm*—Oblon, Spivak, McClelland, Maier & Neustadt, P.C.

[57] ABSTRACT

An image forming apparatus capable of preventing toner deposited on an image carrier from being transferred to an image transfer belt and capable of removing the toner transferred to the belt without lowering a copying speed. When an image transfer medium is absent at a nip formed by the belt and an image carrier contacting each other, a charge of the same polarity as a charge assigned to image transfer is applied from a high-tension power source to the belt.

24 Claims, 8 Drawing Sheets

IMAGE FORMING APPARATUS WHICH CLEANS A TRANSFER BELT BY APPLYING A BIAS VOLTAGE

BACKGROUND OF THE INVENTION

The present invention relates to an electrophotographic image forming apparatus and, more particularly, to a device installed in such an apparatus for transferring a toner image from an image carrier to a paper and separating the paper, carrying the toner image thereon, from the image carrier and a transfer belt.

It has been customary with an electrophotographic image forming apparatus to use an image transferring device for transferring a toner image to a paper. The device includes a charger facing a photoconductive drum or similar rotary image carrier, and a conductive transfer belt having a preselected resistance. A latent image is electrostatically formed on the image carrier and then developed by a developing unit to turn out a toner image. A paper is fed to between the belt and the image carrier and pressed against the image carrier by the belt. In this condition, the toner image transferred from the image carrier to the paper. For the image transfer, use is made of, for example, a corona charger for effecting corona discharge or a contact electrode directly contacting the transfer belt. The contact electrode held in direct contact with the transfer belt is advantageous over the corona charger in that it generates a minimum of ozone and is operable with a small current.

However, the contact electrode scheme has a problem that undesirable toner remaining on the image carrier is often transferred to the transfer belt. Another problem with this kind of scheme is that toner remaining on the transfer belt is apt to deposit on and smear the rear of a paper.

SUMMARY OF THE INVENTION

It is, therefore, an object of the present invention to provide an image forming apparatus capable of preventing toner deposited on an image carrier from being transferred to a transfer belt and capable of removing toner transferred to the belt without lowering a copying speed.

In accordance with the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, in a condition wherein the image transfer medium is absent at a nip formed by the conveying member and image carrier contacting each other, the charge applying device to apply a charge of the same polarity as a charge assigned to a transfer of the toner image to the image transfer medium.

Also, in accordance with the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, in a condition wherein the toner image formed on the image carrier is absent at a nip formed by the conveying member and image carrier contacting each other, the conveying member to contact the image carrier, moving each of the image carrier and conveying member in a predetermined direction, and causing the charge applying device to apply a charge of the same polarity as a charge assigned to image transfer to the conveying member.

Further, in accordance with the present inventon, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, depending on the image forming mode selected, the charge applying device to apply a charge of the same polarity as a charge assigned to image transfer to the conveying meber in a condition wherein the image transfer medium is absent at at nip formed by the conveying member and image carrier contacting each other.

Further, in accordance with the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, depending on the image forming mode selected, the charge applying device to apply a charge of the same polarity as a charge assigned to image transfer to the conveying member in a condition wherein the toner image formed on the image carrier is absent at at nip formed by the conveying member and image carrier contacting each other.

Further, in accordance with the present invention, a image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, when the image transfer medium is absent at a nip formed by the conveying member and image carrier contacting each other, the charge applying device to apply a charge of the same polarity as a charge assigned to image transfer to the conveying member and for changing, depending on the image forming condition, the duration of the charge.

Furthermore, in accordance wtih the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, when the toner image formed on the image carrier is absent at a nip formed by the conveying member and image carrier contacting each other, the charge applying device to apply a charge of the same polarity as a charge assigned to image transfer to the conveying member and for changing, depending on the image forming condition, the duration of the charge.

Moreover, in accordance with the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, depending on the set operating condition of the apparatus, the charge applying device to apply a charge of the same polarity as a charge assigned to image transfer to the conveying member when the image transfer member is absent at a nip formed by the conveying member and image carrier contacting each other.

In addition, in accordance with the present invention, an image forming apparatus has an image carrier for carrying a toner image thereon, an endless conveying member for conveying an image transfer medium and having a medium resistance, a charge applying device for applying a charge to the conveying member in order to transfer the toner image from the image carrier to the image transfer medium, and a controller for causing, depending on the operating condition of the apparatus, the charge applying member to apply a charge of the same polarity as a charge assigned to image transfer to the conveying member when the toner image formed on the image carrier is absent at a nip formed by the conveying member and image carrier contacting each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 9:
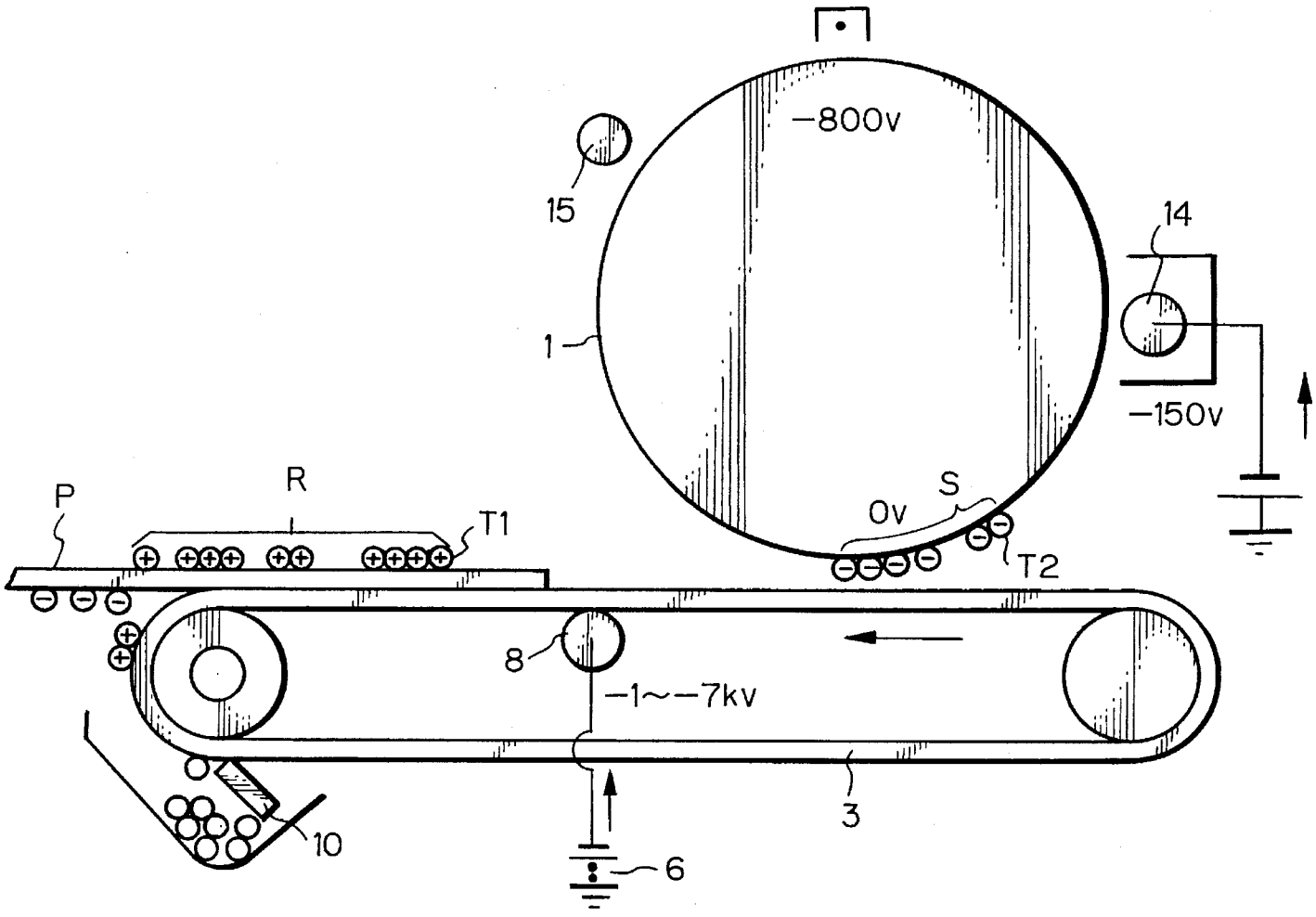
FIG. 9 shows how toner charged to opposite polarity is formed.

Referring to FIG. 9 of the drawings, there is shown an image transferring device included in an image forming apparatus and of the type using a transfer belt. The effects positive-to-positive development, i.e., applies to a transfer belt 3 a bias of polarity opposite to the polarity of a toner image formed on a photoconductive element or image carrier 1. Assume that in a repeat copy mode the bias is applied from a bias roller 8 connected to a power source 6 to the transfer belt 3 during the interval between consecutive papers P. Then, toner forming the toner image and toner deposited on the drum 1 and opposite in polarity to the bias are electrostatically deposited on the belt 3. Such toner increases the load on a blade 10 which is held in contact with the belt 3 for cleaning it. As a result, the blade 10 fails to fully clean the belt 3 and causes the toner of normal polarity to deposit on and smear the rear of the paper P. Originally, toner is not expected to exist in a non-image portion S on the drum 1 since the drum 1 is discharged, or erased, to 0 V by discharging means 15. In practice, however, toner adheres to the drum 1 due to the physical contact of the drum 1 and a developing unit 14 to which a voltage of about −150 V is applied. In addition, toner deposits on, for example, potentials remaining on the drum 1 due to defective erasure which is attributable to the deterioration of the drum 1. In light of this, it has been customary to turn off the bias as far as possible during the interval between consecutive papers, in which the non-image portion of the drum 1 directly contacts the belt 3 due to the absence of the paper P, and before and after image transfer, so that the toner in question may not electrostatically adhere to the belt 3.

The toner present on the drum 1 consists of toner T1 of normal polarity, which is opposite to the polarity of the transfer bias, and forming a transferred image R, and toner T2 of opposite polarity, i.e., of the same polarity as the bias and presumably attributable to the friction between toner particles in the developing unit 14 and irregularities in the charge of toner. The toner T2 is smaller in amount than the toner T1 and is not electrostatically transferred from the drum 1 to the belt 3 only if the bias is applied to the belt 3 or if the drum 1 is fully erased.

On the other hand, Japanese Patent Laid-Open Publication No. 3-69978 teaches an implementation for cleaning a transfer roller to which a transfer bias is applied. The implementation consists in applying a bias of normal polarity and a bias of opposite polarity alternately to the transfer roller before or after the beginning of image transfer or during the interval between consecutive papers. In this condition, toner of normal polarity and toner of opposite polarity deposited on the transfer roller are again transferred to a photoconductive element, so that the transfer roller is cleaned up.

In the device shown in FIG. 9, the belt 3 itself lacks smoothness, and the drum 1 suffers from fatigue which leads to defective erasure. Hence, when the bias for image transfer is turned off, the toner T2 of opposite polarity is apt to deposit on the drum 1 due to the physical contact of the developing unit 14 and drum 1. Moreover, since the toner T2 consists of particles of comparatively small size, it penetrates into the belt 3 easily when the drum 1 and belt 3 contact each other and cannot be removed by the blade 10 with ease. When the bias is applied to the belt 3 for the next image transfer, the toner T2 of the same polarity as the bias is repulsed off the belt 3 and again deposited on the rear of the paper P contacting the belt 3 and on the drum 1, thereby smearing the rear of the paper P.

Further, the charge deposited on the belt 3 charges the drum 1. Therefore, when the drum 1 is brought to a stop as soon as the belt 3, to which the bias is applied, is released form the drum 1, the charges deposited on the drum 1 by the belt 3 and charging means are left on the drum 1. When the residual charge portion of the drum 1 is brought to the developing unit 14 due to the inertia of the drum 1 and developed thereby, black stripes are apt to appear due to the toner of normal polarity. When a copying operation is repeated in such a condition, it is likely that the black stripes are transferred to the belt 3 and left unremoved on the belt 3. Part of such toner on the belt 3 would be transferred to the paper P in the event of contact of the paper P and belt 3, thereby smearing the rear of the paper P.

In previously mentioned Japanese Patent Laid-Open Publication No. 3-69978, the toner of normal polarity and the toner of opposite polarity are returned from the transfer roller to the photoconductive element or an electrode roller by the alternating biases of normal and opposite polarities. However, since a small amount of toner of normal and opposite polarities constantly exists on the photoconductive element, the toner of opposite polarity is caused to deposit on the transfer roller when the element and roller are held in contact. In the transfer roller system, a paper carrying a toner image thereon is separated from the photoconductive element and transfer roller when it moves away from a nip formed by the element and roller contacting each other. However, in a transfer belt system, a paper, moved away from a nip formed by the photoconductive element and belt contacting each other, is electrostatically retained on the belt, conveyed by the belt for a while, and then separated from the belt. Therefore, if the polarity of the bias is switched over before the separation of the paper from the belt, the toner image electrostatically deposited on the paper flies off and results in a blurred image. Although this kind of blur may be obviated if the polarity of the bias is not changed until the paper has been separated from the belt, such an approach increases the interval between consecutive image transfer and thereby lowers the copying speed.

Figure 1:
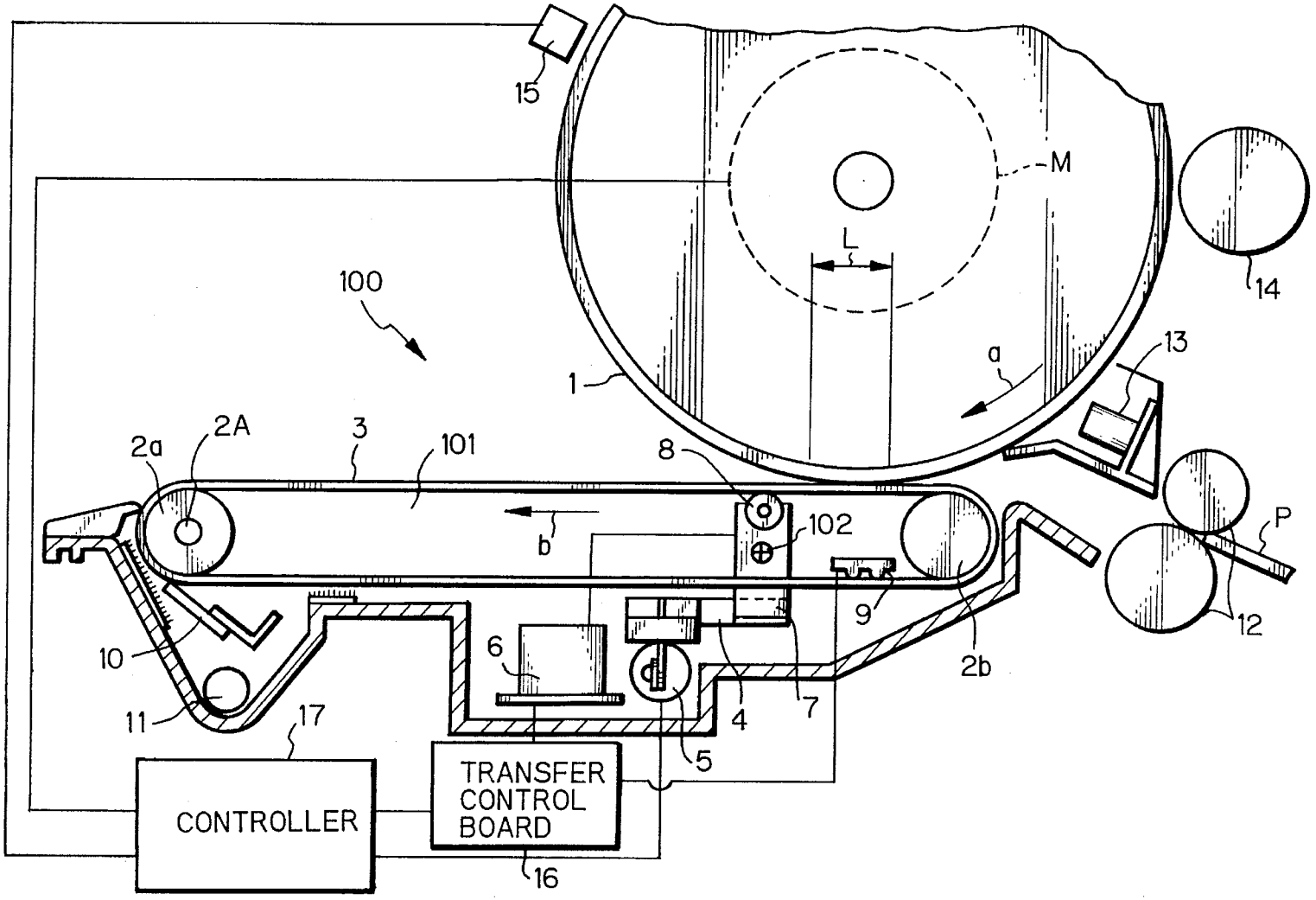
FIG. 1 is a section of an image forming apparatus embodying the present invention.

Referring to FIG. 1, an image forming apparatus embodying the present invention will be described. As shown, the apparatus has an image carrier implemented as a photoconductive drum 1. A main motor, or drive means, M rotates the drum 1 in a direction indicated by an arrow α in the figure. A transfer belt, or endless conveying means, 3 supports a paper or transfer medium P thereon. A DC high-tension power source, or charge applying means, applies a transfer bias to the belt 3 in order to transfer a toner image from the drum 1 to the paper P. A bias roller 8 is supported by a bias terminal 7. The reference numeral 17 designates a controller.

Arranged around the drum 1 are a discharger for discharging the surface of the drum 1, a conventional corona charger or charge roller, not shown, for uniformly charging the drum 1 (see FIG. 9), an exposing section for electrostatically forming a latent image on the drum 1, a developing roller or developing section 14 for developing the latent image, a cleaning unit for removing toner remaining on the drum 1 after image transfer, and other conventional electrophotographic process units. The discharger 15 may be implemented by a quenching lamp or a corona discharger by way of example. In the illustrative embodiment, the drum 1 has a diameter of 100 mm and moves at a linear velocity of 330 mm/sec. The corona charger or charge roller mentioned above uniformly charges the surface of the drum 1 to −800 V. The drum 1 may be replaced with a photoconductive belt, if desired.

An image transferring device 100 is located blow and in close proximity to the drum 1. In the device 100, the belt 3 is passed over a drive roller **2*a* and a driven roller 2*b* and has a predetermined resistance. A lever, or moving means, 4 selectively moves the belt 3 into or out of contact with the drum 1. A DC solenoid 5 is drivably connected to the lever 4. The high-tension power source 6 and bias roller 8 are also positioned below the drum 1. The bias roller 8 is held in contact with part of the inner surface of the belt 3 downstream of a nip L with respect to the direction of movement of the belt 3. A contact plate 9 discharges the belt 3 and feeds back a current returned through the belt 3 to a transfer control board 16. A blade, or cleaning means, 10 cleans the surface of the belt 3. A toner collection roller 11 is disposed below the blade 10**.

Among the various constituents of the image transfer device 100 stated above, the DC solenoid 5, high-tension power source 6, blade 10 and toner collection roller 11 are affixed to a frame, not shown, included in the device 100. The other constituents are mounted on side panels 101 supporting the drive roller **2*a* and driven roller 2*b*. The side panels 101 are mounted on the frame in such a manner as to be rotatable about a shaft 2A on which the drive roller 2*a*** is mounted.

The bias terminal 7 is made of a conductive material and fastened to the side panel 101 by a screw 102. The bias roller 8 is rotatably supported by the upper end of the bias terminal 7. The lever 4, linked to the DC solenoid 5, is held in contact with the lower end of the bias terminal 7. The high-tension power source 6 is connected to the terminal 7 via the transfer control board 16. The transfer control board 16 maintains the current to flow into the drum 1, i.e., the difference between the output current from the high-tension power source 6 and the current fed back from the contact plate 9 constant. Hence, the board 16 causes a constant current to flow through the belt 3 without regard to, for example, the resistance of the paper P contacting the belt 3. In the illustrative embodiment the bias voltage to the belt 3 is variable within the range of from −1 kV to −7 kV.

The belt 3 is made of a conductive material of medium resistance having a volume resistivity of $5\times10^6$ Ωcm to $5\times10^8$ Ωcm, a surface resistivity of $10^9$ Ω to $10^{12}$ Ω on the front, and a surface resistivity of $10^7$ Ω to $10^9$ Ω on the rear, as measured by a method prescribed by JIS (Japanese Industrial Standards) K6911. The belt 3 has a circumferential length of 334 mm and is movable into and out of contact with the drum 1. Specifically, the DC solenoid 5 is selectively turned on or turned off to move the lever 4 upward or downward. As a result, the side panels 101 rotate about the shaft 2A to move the belt 3 into or out of contact with the drum 1. The solenoid 5 is turned on when the leading edge of the paper P approaches the nip L formed by the drum 1 and belt 3 contacting each other, and before the drum 1 is uniformly charged by the main charger, not shown. The drive roller **2*a* is driven in synchronism with the drum 1 by the main motor M via connecting means, not shown. The belt 3 is driven by the drive roller 2*a*** at a linear velocity of 330 mm/sec, as mentioned earlier, and counterclockwise as indicated by an arrow b.

The contact plate 9 is made of a conductive material and connected to ground via the side panels 101. The contact plate 9 is held in contact with the inner surface of the belt 3 beneath the nip L. The contact plate 9 may be located between the nip L and the drive roller **2*a*, if desired. Further, one or both of the rollers 2*a* and 2*b* may play the role of discharging means in place of the contact plate 9. The blade 10 is made of rubber, plastic or similar elastic material and abutted against the surface of the belt 3. In this condition, the blade 10 removes charged toner, paper dust and other impurities from the belt 2**.

Figure 5:
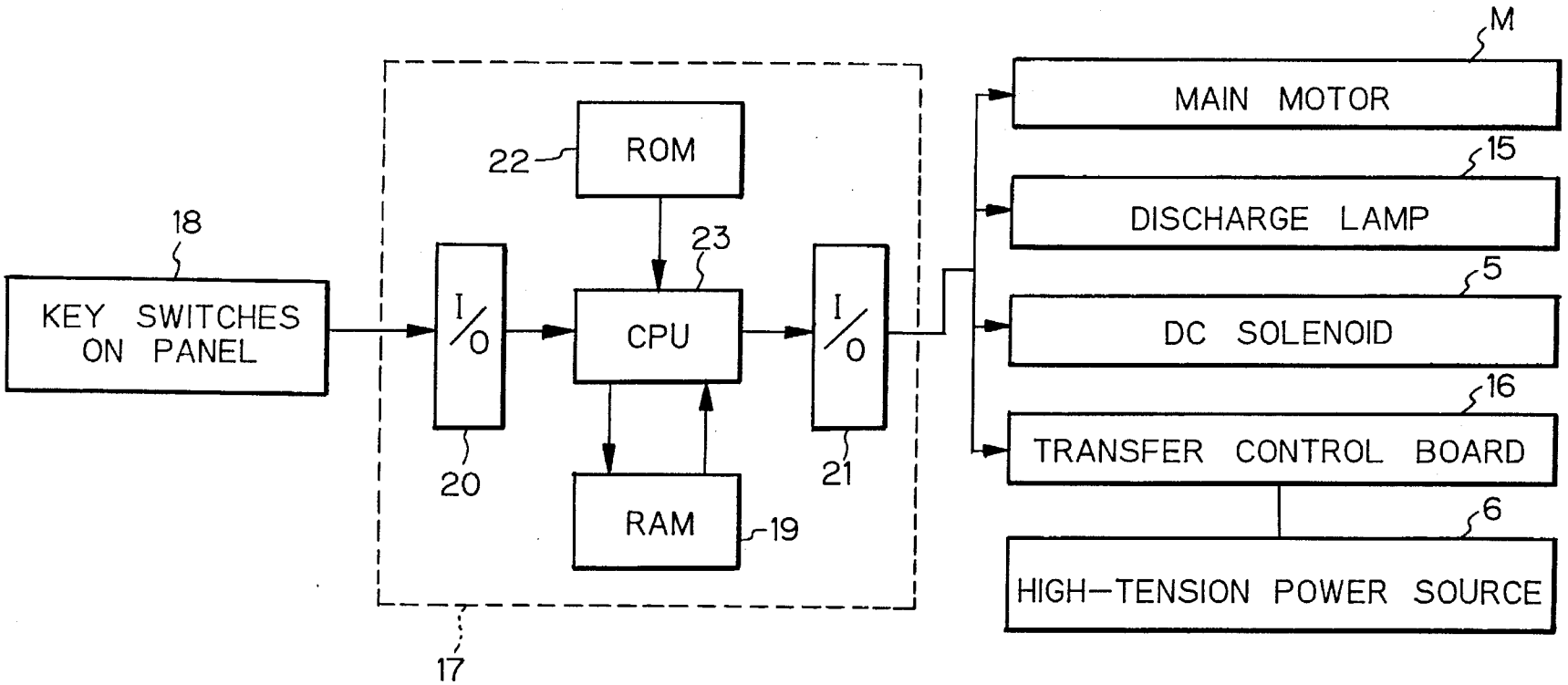
FIG. 5 is a block diagram schematically showing a control system.

As shown in FIG. 5, the discharge lamp 15, DC solenoid 5, main motor M and transfer control board 16 are connected to control means 17 via an input/output (I/O) unit 21. An operation panel 18 is connected to the control means 17 via an I/O unit 20 and provided with various key switches including one for generating a print start command. The control means has essential part thereof implemented by a conventional microcomputer and includes a CPU (Central Processing Unit) 23, a ROM (Read Only Memory) 22, and a RAM (Random Access Memory) 19. The ROM 22 stores an image transfer control program I shown in FIG. 1 and a period of time representing one full rotation of the belt 3. In response to a command signal from the operation panel 18, FIG. 5, the CPU 23 executes the program of FIG. 6 in order to ON/OFF control the members connected to the control means 17.

Referring again to FIG. 1, a registration roller pair 12 is located upstream of the nip L, i.e., at the right-hand side as viewed in the figure. A process unit, not shown, electrostatically forms a latent image on the drum 1, and the developing roller 14 develops it by toner of normal polarity, i.e., positive polarity to produce a corresponding toner image. The registration roller pair 12 drives the paper P such that it meets the leading edge of the toner image formed on the drum 1. A pretransfer lamp (PTL) 13 is disposed above the roller pair 12 in order to reduce, before image transfer, charges deposited on the drum 1. The paper P is conveyed to the registration roller pair 12 by conveying means, not shown, and nipped by the roller pair 12.

The image forming apparatus having the image transfer device 100 will be operated as follows.

First, the key switch provided on the operation panel 18, which is connected to the controller 17, is pressed. Then, in a step S1 shown in FIG. 6, the main motor M and discharge lamp 15 are energized to rotate the drum 1 and belt 3 and discharge, or erase, the surface of the drum 1. Subsequently, the DC solenoid 5 is energized to press the belt 3 against the drum 1 to form the nip L (step S2). The high-tension power source 6 is driven to apply a bias of −1 kV to −7 kV to the bias roller 8, thereby charging the belt 3 (step S3). Consequently, among toner particles remaining on the belt 3, particles of positive or normal polarity are left on the belt 3 while particles of opposite polarity, i.e., of the same polarity as the bias are removed from the belt 3. At this instant, the drum 1 and belt 3 have already been rotated by the main motor M (step S4). Hence, the particles of normal polarity are scraped off by the blade 10. In this manner, both the particles of normal polarity and those of opposite polarity are removed from the belt 3.

As stated above, before the start of a copying operation, i.e., when neither the paper P nor the toner image is present (not arrived) at the nip L (labeled A in FIG. 4), the lever 4 is driven to bring the belt 3 into contact with the non-charged drum 1. At the same time, the bias is applied to the belt 3 via the bias roller 8. In this condition, the belt 3 is rotated at least over the circumferential length thereof (interval A in FIG. 4) to be thereby precleaned.

Figure 2:
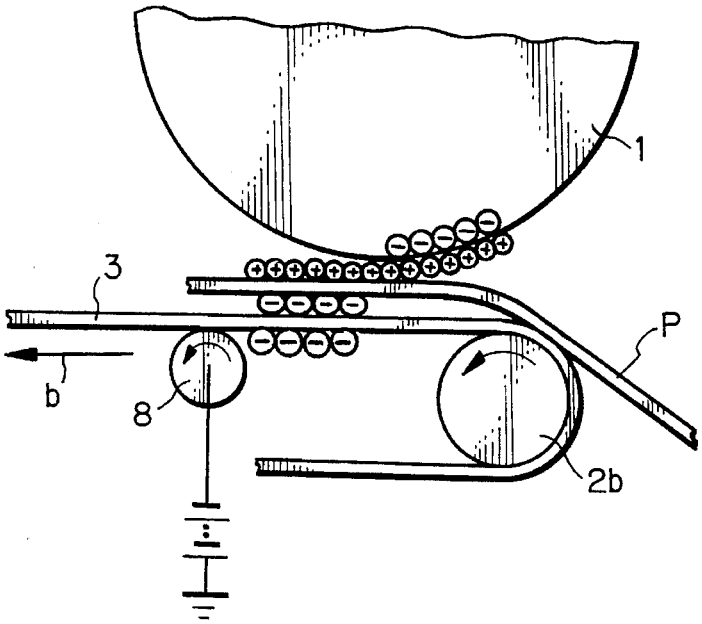
FIG. 2 demonstrates how charges are deposited during image transfer.
Figure 3:
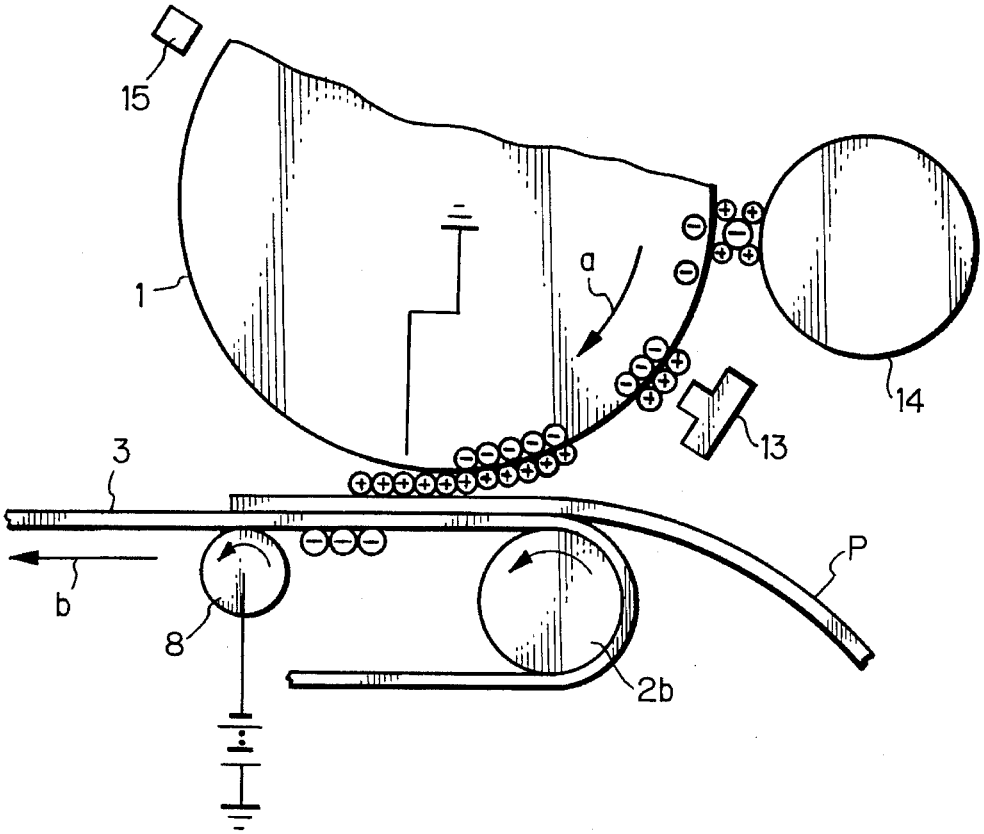
FIG. 3 shows a bias for image transfer which is applied to a transfer belt.

After the precleaning (step S4), the exposing section, not shown, starts scanning the drum 1 (step S5). The process unit, including the developing roller 14, forms a toner image on the drum 1 by toner of normal polarity. The registration roller pair 12 drives the paper P such that it meets the leading edge of the toner image. When the paper P enters the nip L, as shown in FIGS. 2 and 3, the belt 3 applied with the bias charges the paper P to negative polarity. As a result, the toner image is transferred from the drum 1 to the paper P. The paper P, carrying the toner image thereon, is conveyed by the belt 3 in the direction b while electrostatically adhering to the belt 3. As the belt 3 sequentially moves to the downstream side, the bias applied to the belt 3 and paper P is dissipated by the contact plate 9. This is the end of the copying operation for the first paper P.

Subsequently, whether or not a copying operation is under way is determined on the basis of the desired number of copies entered on the operation panel 18 (step S6). When a plurality of copies are desired, the image transfer described above is repeated and then followed by a step S7. When a single copy is desired, the image transfer is immediately followed by the step S7.

Figure 4:
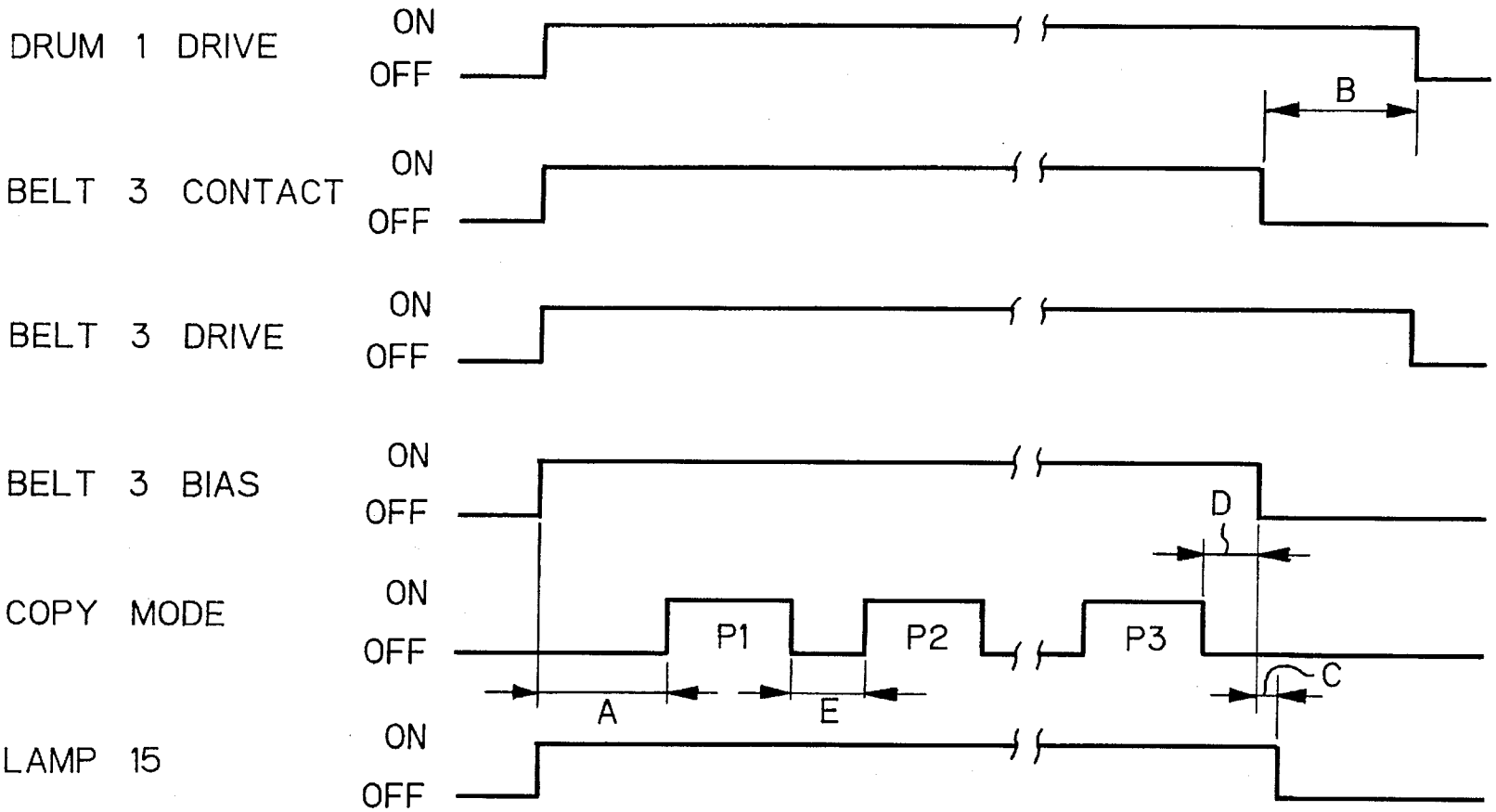
FIG. 4 is a timing chart showing an image forming procedure together with the drive of various units to occur before and after the procedure.

When a plurality of copies are to be produced, an interval E, FIG. 4, occurs between the end of image transfer to the preceding paper P1 and the beginning of image transfer to the following paper P2. During this interval E, since the following paper P2 has not been fed to between the belt 3 and the drum 1 yet, the belt 3 and drum I directly contact each other. In this condition, the toner particles of normal polarity and those of opposite polarity deposited on the drum 1 are apt to physically rub themselves against the belt 3 due to the contact and rotation of the drum 1 and belt 3. The embodiment is free from this problem since the bias applied to the belt 3 causes the particles of opposite polarity to be repulsed off the belt 3, thereby cleaning the belt 3.

Assume that during the above-mentioned interval E the bias is switched from negative polarity to positive polarity, as taught in previously discussed Japanese Patent Laid-Open Publication No. 3-69978. Then, the belt 3 will be successfully cleaned by repulsing the toner particles of positive polarity, but the particles of opposite polarity will deposit on the belt 3. Assuming that a paper of format A4 is fed in a laterally long position, the interval E between the papers P1 and P2 is about 0.5 second which is too short for the illustrative embodiment to switch over the polarity of the bias. Even though the polarity may be switched over within such a short interval, it is difficult to apply an ideal bias to the belt 3 immediately due to the buildup time of the voltage, resulting in defective image transfer. Granting that an ideal bias could be applied to the belt 3, the toner particles of opposite polarity electrostatically deposited on the belt 3 would be transferred to the rear of the paper P in the event of separation of the paper P from the belt 3. In this way, various problems will be brought about when the implementation for cleaning a transfer roller by use of a transfer bias is simply applied to the transfer belt 3.

Figure 6:
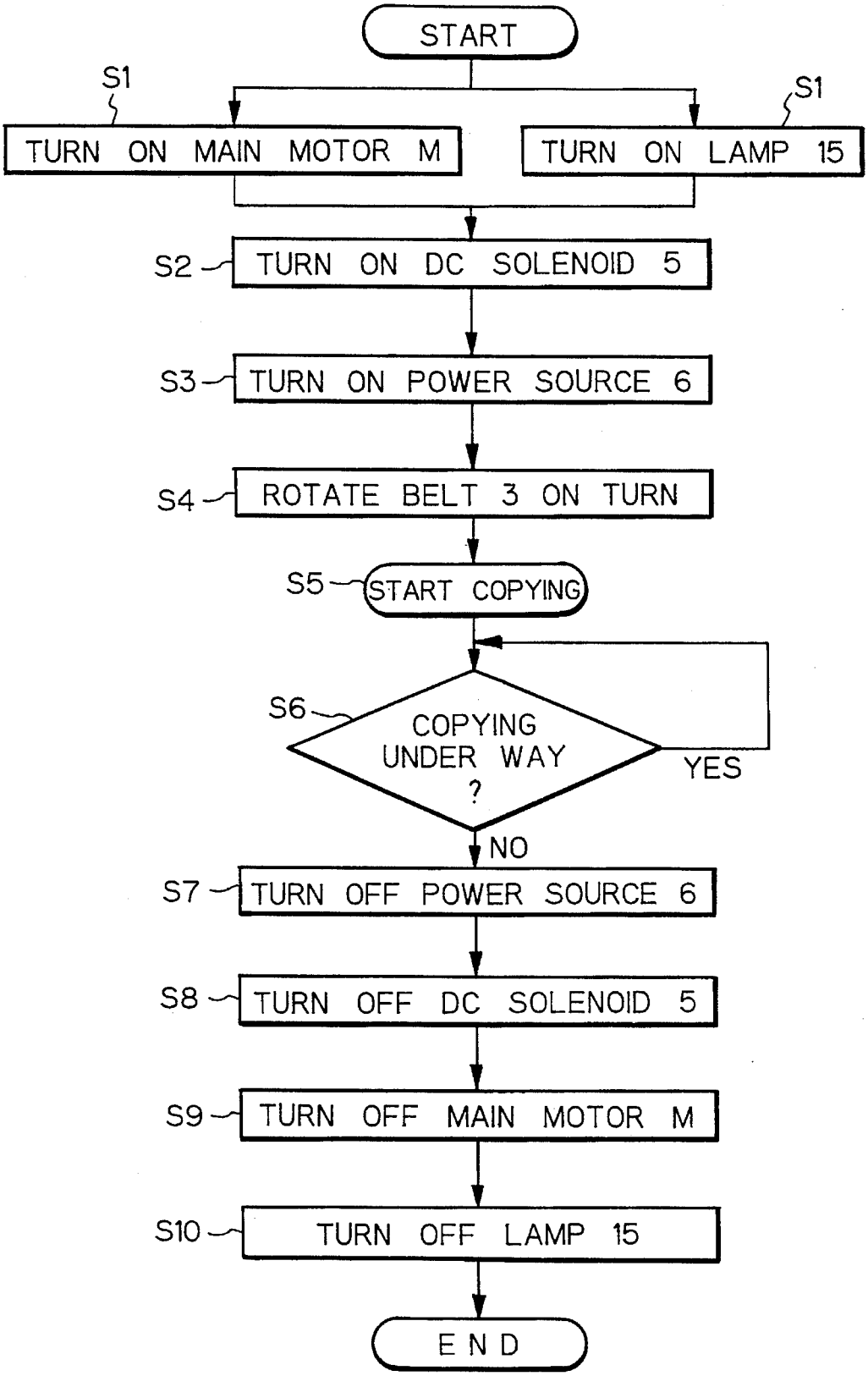
FIG. 6 is a flowchart demonstrating an image transfer control program I.

In the step S7, FIG. 6, the high-tension power source 6 is turned off to interrupt the bias to the belt 3. Then, the DC solenoid 5 is deenergized to release the belt 3 from the drum 1 (step S8). Subsequently, the main motor M is deenergized to stop rotating the belt 3 and drum 1 (step S9). Finally, the discharge lamp 15 is turned off (step S10).

As stated above, the embodiment does not release the belt 3 from the drum 1 or interrupt the bias immediately after the copying operation, i.e., when neither the paper P nor the toner image is present at the nip L. Instead, the embodiment causes the lever 4 to release the belt 3 from the drum 1 on the elapse of a predetermined period of time D, FIG. 4, and continuously applies the bias to the belt 3 up to or substantially up to the end of the period of time D. Hence, the bias is continuously applied to the belt 3 until the copying operation ends. This prevents toner of opposite polarity, if present, from electrostatically adhering to the belt 3. Even if such undesirable toner deposits on the belt 3 and drum 1 due to friction, the former is repulsed off from the latter.

In the embodiment, the bias is continuously applied to the belt 3 while the drum 1 and belt 3 are held in contact, as described above. In this condition, toner of normal polarity is deposited on the belt 3, but toner of opposite polarity is prevented from being transferred from the drum 1 to the belt 3. In addition, toner of normal polarity electrostatically deposited on the belt 3 is scraped off by the blade 10 and, therefore, prevented from smearing the rear of the paper P. Even though the blade 10 may fail to fully scrape off the toner of normal polarity from the belt 3, the toner to remain on the belt 3 is small in amount and is electrostatically retained on the belt 3 by the bias continuously applied to the belt 3 until the release of the belt 3 from the drum 1. This successfully prevents the toner from being transferred to the rear of the paper P.

As shown in FIG. 4, during an interval B before the stop of drive of the drum 1 and belt 3, the quenching lamp, corona discharger or similar discharger 15 located above the drum 1 is energized to fully discharge the charged portion of the drum 1. Thereafter, the drum 1 is brought to a stop. As a result, even when the surface of the drum 1 reaches the developing roller 14 due to inertia, toner does not deposit on the drum 1 since no potential is left thereon. Hence, black stripes attributable to toner charged to positive polarity and deposited on residual potentials are reduced.

An alternative embodiment of the present invention will be described hereinafter. Briefly, this embodiment omits the one full rotation of the belt 3 executed in the previous embodiment and uses whether or not the paper P is present at the nip L as a parameter. The alternative embodiment is identical in construction with the previous embodiment except for an image transfer program II shown in FIG. 7. The same constituent parts of this embodiment as or to the parts of the previous embodiment are designated by the same reference numerals, and a detailed description thereof will not be made in order to avoid redundancy.

Figure 7:
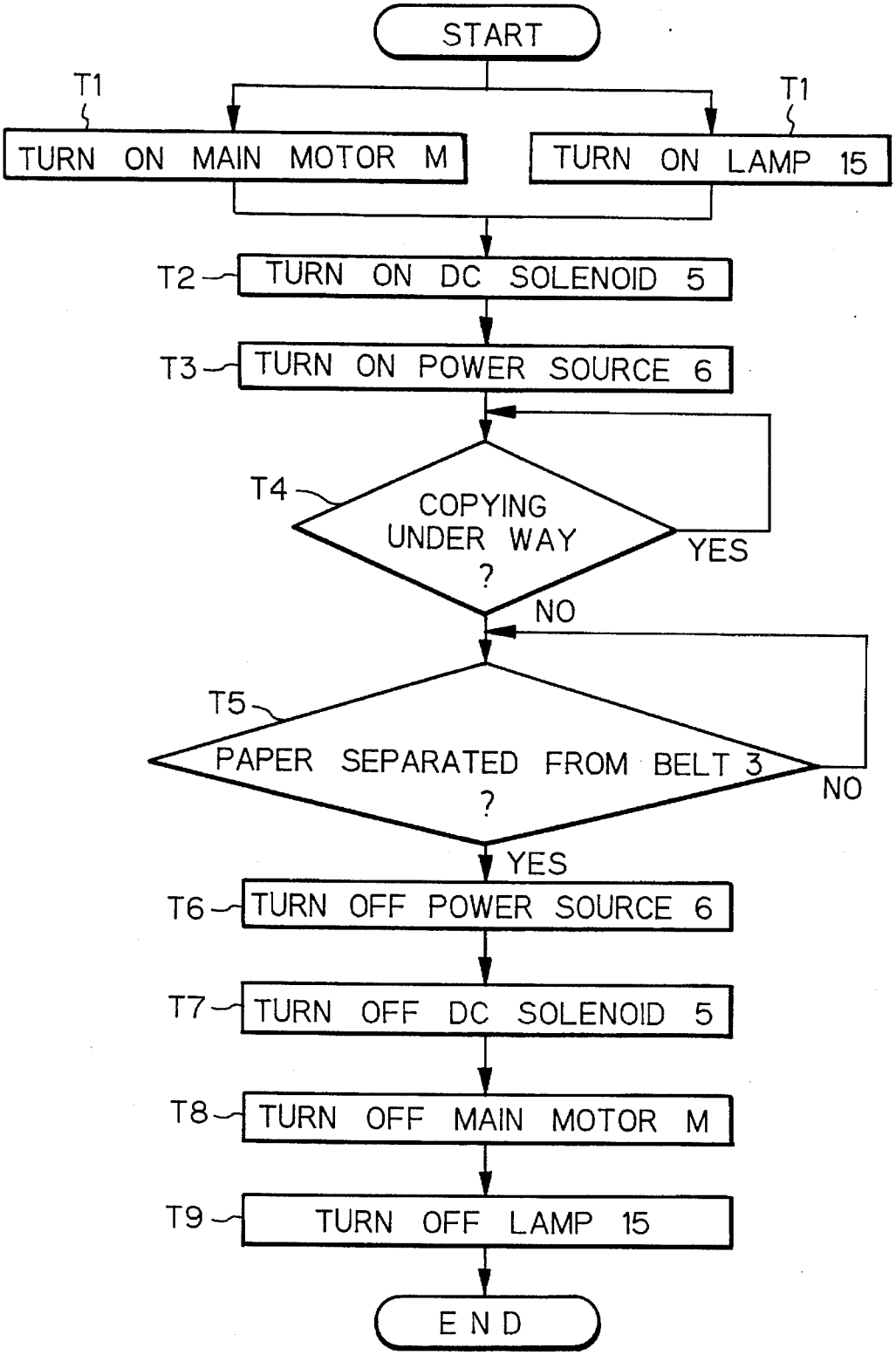
FIG. 7 is a flowchart demonstrating an image transfer control program II.

The image transfer control program II shown in FIG. 7 is also stored in the ROM 22 of the controller 17, FIG. 5, and executed when the key switch provided on the operation panel 18 is operated. Connected to the CPU 23, the ROM 22 also stores data representing the intervals between the consecutive papers P1 and P2 and based on paper sizes and magnifications, and periods of time representing distance data to the position where the paper P is separated from the belt 3. On the operation of the key switch, a timer built in the controller 17 starts counting time. In this embodiment, when the key switch is operated, exposing means, not shown, is turned on to scan a document, not shown.

Figure 8:
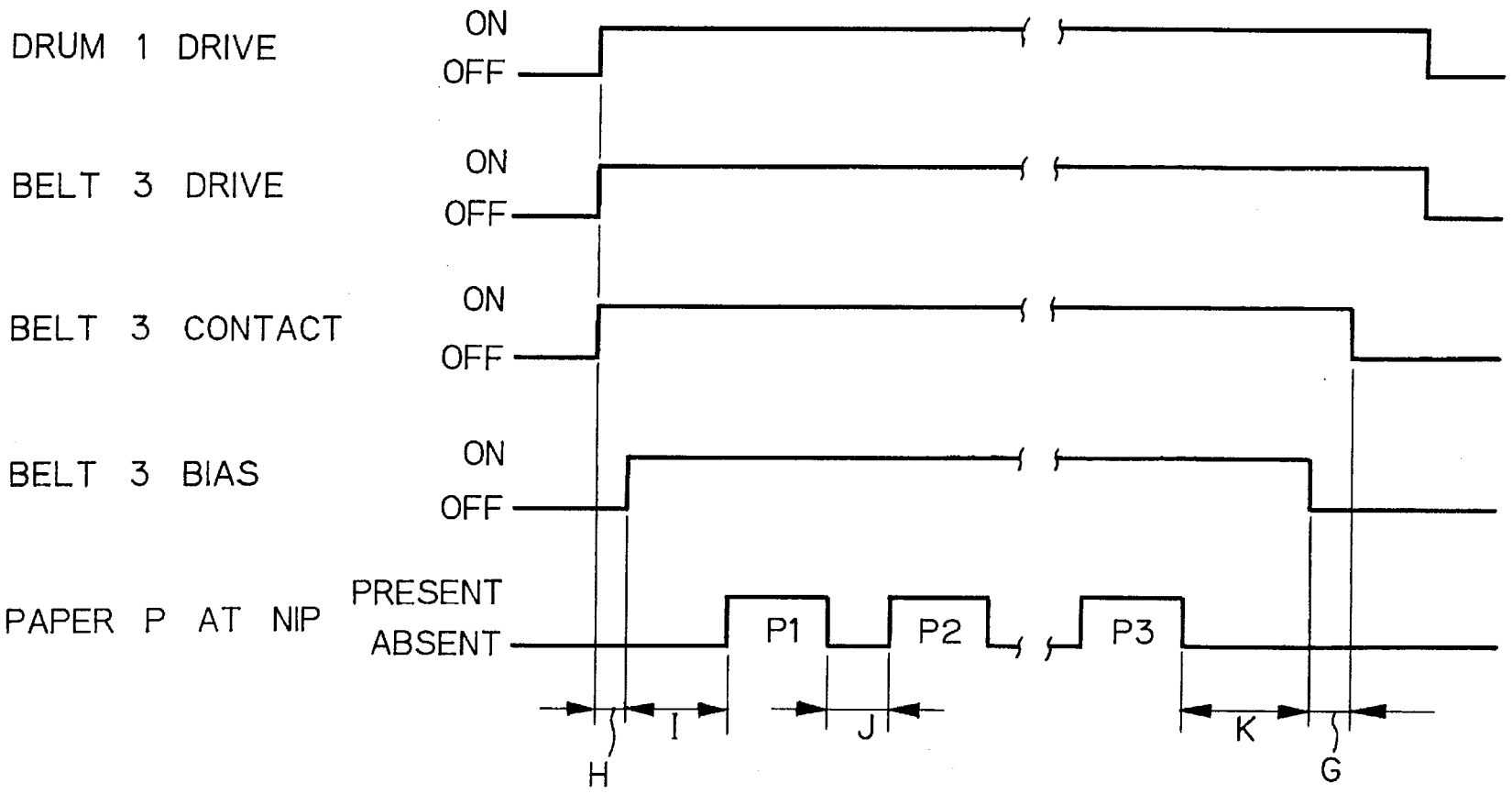
FIG. 8 is a timing chart showing an image forming procedure together with the alternative drive of various units to occur before and after the procedure.

In operation, when the key switch on the operation panel 18 is pressed, the main motor M and discharge lamp 15 are turned on (step T1). As a result, the drum 1 and belt 3 start rotating at the same time, as shown in FIG. 8; the surface of the drum 1 is discharged or erased. Further, the exposing means starts scanning a document in order to form a toner image on the drum 1. At this instant, the controller 17 counts time.

Subsequently, the DC solenoid 5 is energized to press the belt 3 against the drum 1, thereby forming the nip L (step T2). Then, the high-tension power source 6 is driven to apply a bias of −1 kV to −7 kV to the belt 3 (step T3). Consequently, during an interval I, FIG. 8, before image transfer and in which a toner image is absent at the nip L, toner of normal or positive polarity remaining on the belt 3 electrostatically adheres to the belt 3 while toner of opposite or negative polarity is removed from the belt 3. That is, the toner of opposite polarity is removed from the belt 3 before the image transfer to the paper P. At this instant, the drum 1 and belt 3 have already been rotated by the main motor M. Hence, the particles of normal polarity are scraped off by the blade 10, FIG. 1. In this manner, both the particles of normal polarity and those of opposite polarity are removed from the belt 3.

On the arrival of the paper P at the nip L, whether or not a copying operation is under way is determined on the basis of the desired number of copies entered on the operation panel 18. When a plurality of copies are desired, the image transfer described above is repeated and then followed by a step T5. When a single copy is desired, the image transfer is immediately followed by the step T5. When a single copy is desired, the controller 17 counts a period of time matching the distance data necessary for the separation of a single paper (step T5). On counting up such a period of time, it turns off the high-tension power source 6 to interrupt the bias to the belt 3, determining that the paper P has been separated from the belt 3 (step T6). When a plurality of copies are desired, the controller 17 counts a period of time up to the separation of the last paper P3, FIG. 8. On counting up this period of time, the controller 17 turns off the power source 6 to interrupt the bias to the belt 3, determining that the last paper P3 has been separated from the belt 3 (step T6).

After the step T6, the controller 17 deenergizes the DC solenoid 5 to release the belt 3 from the drum 1 (step T7), turns off the main motor M to stop rotating the drum 1 and belt 3 (step TS), and then turns off the discharge lamp 15 (step T9).

In FIG. 8, the interval between the preceding paper P1 and the following paper P2 is labeled 3. During this interval J, the belt 3 and drum 1 directly contact each other. In this condition, the toner particles of normal polarity and those of opposite polarity deposited on the drum 1 are apt to physically rub themselves against the belt 3 due to the contact and rotation of the drum 1 and belt 3. The embodiment is free from this problem since the bias applied to the belt 3 causes the particles of opposite polarity to be repulsed off the belt 3, thereby cleaning the belt 3.

As stated above, the embodiment causes the belt 3 to directly contact the drum 1 and continuously feeds the bias to the belt 3 during the interval I, FIG. 8, before image transfer and in which neither the paper P nor the toner image is present at the nip L. This successfully frees the belt 3 from smears due to the direct contact of toner of opposite polarity with the belt 3 and prevents the toner from being transferred to the rear of the paper P. Further, the bias is continuously applied to the belt 3 while the belt 3 and drum 1 are in contact and until the last paper P3 moves away from the nip L. As a result, toner is prevented from depositing on the belt 3 during an interval K also shown in FIG. 8. In addition, since the bias is continuously applied to the belt 3 even during the interval J between the consecutive papers P, it is possible to prevent toner of the same polarity as the bias from depositing on the belt 3.

The embodiment applies the bias to the belt 3 substantially at the same time as the belt 3 is brought into contact with the drum 1 and interrupts the bias when the belt 3 is released from the drum 1. Therefore, even when the drum 1 and belt 3 are in contact, i.e., during the intervals I, J and K, FIG. 8, toner of the same polarity as the bias to the belt 3 is prevented from depositing on the belt 3. In FIG. 8, an interval H represents a period of time necessary for the DC solenoid 5 to start up while an interval G represents a period of time necessary for the bias to be fully interrupted. In the embodiment, the interval G is assumed to be zero.

In the illustrative embodiment, the belt 3 is moved at a linear velocity of 330 mm/sec so as to deal with fifty-five papers P of format A4 for a minute. Hence, the interval J between the consecutive papers is about 150 mm, i.e., 0.45 mm/sec in terms of time.

On the other hand, when the paper P jams the path due to faulty transport, the paper P and toner image will also be absent at the nip L. Considering the jam and following recovery, the embodiment provides the controller 17 with a jam recovery mode. For the jam recovery mode, a particular interval between the pick-up of the paper P and the arrival thereof at the nip L and a particular period of time up to the separation of the paper P from the belt 3 are preset on a paper size and copy number basis. When the paper P is not sensed on the elapse of any one of such periods of time, the controller 17 determines that it has jammed the path. The controller 17 executes jam recovery during the interval I, FIG. 8, preceding image transfer and in which the belt 3 is held in direct contact with the drum 1 and applied with the bias via the bias roller 8. While the interval I should preferably be longer than a period of time matching one rotation of the belt 3, it is, in practice, selected to be as long as possible within an allowable range since priority is given to the first paper P1 as to image transfer. In the illustrative embodiment, since the belt 3 is movable at a linear velocity of 330 m/sec and since the belt is 334 mm long, it takes about 1 second for the belt 3 to complete one rotation. For this reason, the interval I before image transfer should preferably be at least 1 second.

The number of times that the interval J shown in FIG. 8 occurs increases with an increase in the number of copies to be produced, thereby increasing the duration of contact of the drum 1 and belt 3. As a result, the amount of toner transfer from the drum 1 to the belt 3 is apt to increase. In light of this, the embodiment additionally provides the controller 17 with an extended bias mode. For the extended bias mode, a preselected number of copies is set, and the number of copies produced is counted. When the preselected number of copies is reached, the duration of the OFF state of the DC solenoid 5 is extended to apply the bias to the belt 3 over a longer period of time. For example, when the bias is applied to the belt 3 for a duration matching one rotation of the belt 3 until the preselected number of copies has been reached, a duration matching two rotations of the belt 3 may be assigned to the extended bias mode. In this manner, by extending the period of time or interval K, FIG. 8, after the copying operation, it is possible to extend the duration of the bias to the belt 3 and, therefore, to obviate the deposition of the toner of the same polarity as the bias on the belt 3 over a longer period of time.

While the embodiments have been shown and described in relation to a simplex copy mode which forms an image on one side of a paper, they are also practicable with a duplex copy mode which forms an image on both sides of a paper. In the duplex copy mode, the controller 17 causes the direct contact of the belt 3 with the drum 1 and the application of the bias to the belt 3 to occur before the paper P, refed in the duplex copy mode, arrives at the image transfer position, i.e., during the interval I shown in FIG. 8. The paper P carrying an image on one side thereof is held on an intermediate tray. When a toner image to be transferred to the other side of such a paper P is formed on the drum 1, the paper P is driven toward the nip L by the registration roller pair 12, FIG. 1. Hence, the period of time necessary for the one-sided paper P to reach the nip L in the duplex copy mode is shorter than the period of time necessary for a fresh paper fed from a cassette, not shown, to reach the nip L. It is, therefore, possible to reduce the transfer of toner from the drum 1 to the belt 3 while reducing the copying time in the duplex copy mode. This is also true with a combination copy mode available for transferring, for example, a plurality of images to the same side of a single paper.

Another alternative embodiment of the present invention will be described which is capable of changing the bias to the belt 3, depending on the presence/absence of the paper P and toner image at the nip L. In the case of constant current control, the bias to the belt 3 is variable over the range of −1 kV to −7 kV. When the paper P and toner image are present at the nip L, the bias is varied over such a range. However, when neither the paper P nor the toner image is present at the nip L, the bias should only be −1 kV for the following reason. In such a condition, since the potential of the drum 1 is 0 V, the bias to the belt 3 does not have to be as high as the bias in the other condition. Hence, only if a bias slightly greater than the surface potential of the drum 1 on the negative side is set up, it is possible to prevent toner of opposite polarity from being transferred from the drum 1 to the belt 3 and to reduce ozone and leak attributable to a discharge particular to the separation of the paper P from the belt 3.

The photoconductive element 1 implemented as a drum or a belt and playing the role of an image carrier may be replaced with an endless transfer element also implemented as a drum or a belt. In the event of color image formation, toner images of different colors are sequentially transferred to the intermediate transfer element one above the other and then collectively transferred from the element to a paper. Also, the bias roller 8 playing the role of charge applying means may be replaced with a brush, blade or similar contact electrode or with a charger or similar noncontact electrode. While the bias to the belt 3 has been shown and described as being of negative polarity, it may be of positive polarity if allowable in relation to the image forming process and the polarity of the drum 1. In addition, the positive-to-positive development shown and described may be replaced with negative-to-positive development using toner of the same polarity as the drum 1.

The embodiments control the bias to the belt 3 by a differential constant current control system, i.e., by maintaining the current necessary for image transfer constant. Such a control system may, of course, be replaced with a constant voltage control system which maintains the voltage necessary for image transfer constant. In addition, the control means 17 for executing the differential constant current control may be constructed integrally with the transfer control board 16.

In summary, it will be seen that the present invention provides an image forming apparatus having various unprecedented advantages, as enumerated below.

(1) Even when a paper is absent at a nip formed by a transfer belt and a photoconductive element contacting each other, a controller causes a charge of the same polarity as a charge for image transfer to be applied to the belt. Hence, the belt is constantly charged by such a charge, so that toner of the same polarity as the bias is prevented from depositing on the belt.

(2) The condition wherein the paper is absent at the nip extends from the time when the apparatus starts operating to the time when a paper arrives at the nip. Hence, before image transfer, the belt is charged by the charge of the same polarity as the charge for image transfer and fed from a high-tension power source. This prevents the toner of the same polarity as the bias from depositing on the belt before image transfer.

(3) The condition wherein the paper is absent at the nip occurs after a paper has moved away from the nip. Hence, after a paper has moved away from the nip, the belt is charged by the charge of the same polarity as the charge for image transfer and fed from the high-tension power source. This prevents toner of the same polarity as the bias from depositing on the belt after image transfer.

(4) The period following the movement of a paper away from the nip extends from the time when a paper moves away from the nip to the time when it is separated from the belt. In this condition, the belt is continuously charged by the charge of the same polarity as the charge for image transfer and fed from the high-tension power source until the separation of the paper from the belt. It follows that the toner of the same polarity as the bias is prevented from depositing on the belt until the separation of the paper from the belt.

(5) The period following the movement of the paper away from the nip extends from the time when a paper moves away from the nip to the time when the belt and photoconductive element are released from each other. Hence, the belt is continuously charged by the charge of the same polarity as the charge for image transfer and fed from the high-tension power source until the separation of the belt and element. This prevents the toner of the same polarity as the bias from depositing on the belt until the separation of the belt and element.

(6) The condition wherein a paper is absent at the nip occurs during the interval between consecutive papers with which image formation is to be repeated. The belt is, therefore, charged by the charge of the same polarity as the charge for image transfer and fed from the high-tension power source during the above-mentioned interval. This prevents the toner of the same polarity as the bias from depositing on the belt during such an interval.

(7) The charge from the high-tension power source is applied to the belt substantially at the same time as the contact of the photoconductive element and belt and then interrupted substantially at the same time as the release of the same. Hence, the charge is continuously applied to the belt from the time when the element and belt contact to the time when they separate. This prevents toner of the same polarity as the bias from depositing on the belt while the element and belt are held in contact.

(8) The charge from the high-tension power source is switched over depending on the presence/absence of a paper at the nip. This changes the charge condition of the belt depending on the presence/absence of a paper at the nip. As a result, toner of the same polarity as the bias and deposited on the photoconductive element while a paper is absent at the nip is prevented from depositing on the belt. Also, ozone attributable to a discharge to occur when a paper is separated from the belt, as well as a leak, is reduced.

(9) Even when a toner image formed on the photoconductive element is absent at the nip, the charge of the same polarity as the charge for image transfer is applied to the belt. This prevents toner of the same polarity as the bias from depositing on the belt.

(10) When a toner image formed on the photoconductive element is absent at the nip, the charge of the same polarity as the charge for image transfer is applied to the belt from the high-tension power source. Therefore, toner of the same polarity as the bias is prevented from depositing on the belt while a toner image is absent at the nip.

(11) The charge of the same polarity as the charge for image transfer is applied, depending on a set image forming mode, from the high-tension power source to the belt when a paper or a toner image formed on the photoconductive element is absent at the nip. Hence, toner of the same polarity as the bias is prevented from depositing on the belt in the above condition.

(12) The set image forming mode is a duplex copy mode for forming a toner image on both sides of a paper. Therefore, in the duplex copy mode and when a paper or a toner image is absent at the nip, the belt is charged by the charge of the same polarity as the charge for image transfer and fed from the high-tension power source. This prevents toner of the same polarity as the bias from depositing on the belt in the duplex copy mode.

(13) The condition wherein a paper or a toner image formed on the photoconductive element is absent at the nip extends from the time when a paper, carrying a toner image on one side thereof, moves away from the nip to the time when it arrives at the nip for the image transfer to the other side. Hence, the belt is charged by the charge of the same polarity as the charge for image transfer and fed from the high-tension power source from the end of image transfer to one side to immediately before the image transfer to the other side. This prevents toner of the same polarity as the bias from depositing on the belt during such an interval.

(14) Controller changes the charge condition of the belt depending on an image forming condition and when a paper or a toner image formed on the photoconductive element is absent at the nip. This prevents toner of the same polarity as the bias from depositing on the belt in association with the image forming condition.

(15) The image forming condition is the number of times of image formation. Hence, when the paper or the toner image is absent at the nip, the charge of the same polarity as the charge for image transfer and fed from the high-tension power source changes depending on the number of times of image formation. This prevents toner of the same polarity as the bias from depositing on the belt in association with the number of times of image formation.

(16) The charge of the same polarity as the charge assigned to image transfer is applied from the high-tension power source to the belt when a paper or a toner image is absent at the nip and in association with the operating condition of the apparatus. Therefore, toner of the same polarity as the bias is prevented from depositing on the belt in the above condition.

(17) When a toner image is absent at the nip and the transport of a paper is faulty, the charge of the same polarity as the charge for image transfer is applied from the high-tension power source to the belt. This prevents toner of the same polarity as the bias from depositing on the belt when the paper transport is faulty.

(18) After the recovery from the faulty paper transport, the charge of the same polarity as the charge for image transfer is continuously applied to the belt until the first paper or the first toner image arrives at the nip. Therefore, toner of the same polarity as the bias is prevented from depositing on the belt until the arrival of such a paper or toner image at the nip.

Various modifications will become possible for those skilled in the art after receiving the teachings of the present disclosure without departing from the scope thereof.

What is claimed is:

1. An image forming apparatus, comprising:

an image carrier for carrying a toner thereon;

endless conveying means for conveying an image transfer medium;

charge applying means for applying a charge to said endless conveying means in order to transfer the toner image from said image carrier to the image transfer medium;

control means for controlling, when the image transfer medium is absent from a nip formed by said endless conveying means and said image carrier contacting each other, said charge applying means to apply a charge having a same polarity as a charge which transfers the toner image to the image transfer medium;

drive means for moving each of said image carrier and endless conveying means in a predetermined direction; and moving means for selectively moving said conveying means into or out of contact with said image carrier, said endless conveying means forming said nip when in contact with said image carrier.

2. An apparatus as claimed in claim 1, wherein:

said control means controls said charge applying means to apply the charge having the same polarity for a period between a time when an image forming operation begins to a time when the image transfer medium arrives at said nip.

3. An apparatus as claimed in claim 1, wherein:

said control means controls said charge applying means to apply the charge having the same polarity after the image transfer medium has moved away from said nip.

4. An apparatus as claimed in claim 3, wherein:

said control means controls said charge applying means to apply the charge having the same polarity for a period between a time when the image transfer medium moves away from said nip to a time when the image transfer medium is separated from said endless conveying means.

5. An apparatus as claimed in claim 3, wherein:

said control means controls said charge applying means to apply the charge having the same polarity for a period between a time when the image transfer medium moves away from said nip to a time when said endless conveying means is released from said image carrier.

6. An apparatus as claimed in claim 3, wherein:

said control means controls said charge applying means to apply the charge having the same polarity during an interval between consecutive image transfer media with which image transfer is to be repeated.

7. An apparatus as claimed in claim 1, wherein:

said control means controls said charge applying means to apply said charge to said endless conveying means substantially at a same time as a contact of said conveying means with said image carrier and to stop applying said charge substantially at a same time as a release of said endless conveying means from said image carrier.

8. An apparatus as claimed in claim 1, wherein said control means controls said charge applying means to apply said charge depending on a presence or absence of the image transfer medium at said nip.

9. An image forming apparatus, comprising:

an image carrier for carrying a toner image thereon;

endless conveying means for conveying an image transfer medium, the endless conveying means and the image carrier contacting each other at a nip;

charge applying means for applying a charge to said endless conveying means in order to transfer the toner image from said image carrier to the image transfer medium; and control means for controlling said charge applying means to apply a charge having a same polarity as a charge which transfers the toner image to the image transfer medium while the image transfer medium is absent from said nip, the image transfer medium being absent from said nip for a period between a time when image formation begins to a time when the image transfer medium arrives at said nip.

10. An image forming apparatus, comprising:

an image carrier for carrying a toner image thereon;

endless conveying means for conveying an image transfer medium, the endless conveying means and the image carrier contacting each other at a nip;.

charge applying means for applying a charge to said endless conveying means in order to transfer the toner image from said image carrier to the image transfer medium; and control means for controlling said charge applying means to apply a charge having a same polarity as a charge which transfers the toner image to the image transfer medium while the image transfer medium is absent from said nip, the image transfer medium being absent from said nip after the image transfer medium has moved away from said nip.

11. An apparatus as claimed in claim 10, wherein:

said control means controls said charge applying means to apply the charge having the same polarity for a period between a time when the image transfer medium moves away from said nip to a time when the image transfer medium is separated from said endless conveying means.

12. An apparatus as claimed in claim 10, wherein:

said control means controls said charge applying means to apply the charge having the same polarity for a period between a time when the image transfer medium moves away from said nip to a time when said endless conveying means is released from said image carrier.

13. An image forming apparatus, comprising:

an image carrier for carrying a toner thereon;

endless conveying means for conveying an image transfer medium;

charge applying means for applying a charge to said endless conveying means in order to transfer the toner image from said image carrier to the image transfer medium;

control means for controlling, when the image transfer medium is absent from a nip formed by said endless conveying means and said image carrier contacting each other, said charge applying means to apply a charge having a same polarity as a charge which transfers the toner image to the image transfer medium;

wherein said control means controls said charge applying means to apply said charge to said conveying means substantially at a same time as a contact of said endless conveying means with said image carrier and to stop applying said charge substantially at a same time as a release of said endless conveying means from said carrier.

14. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium;

control means for controlling, when the toner image formed on said image carrier is absent from a nip formed by said conveying means and said image carrier contacting each other, said endless conveying means to contact said image carrier, moving each of said image carrier and said conveying means in a predetermined direction, and causing said charge applying means to apply a charge of a same polarity as a charge assigned to image transfer to said conveying means;

drive means for driving each of said image carrier and said endless conveying means in the predetermined direction; and moving means for supporting said endless conveying means such that said endless conveying means is movable into and out of contact with said image carrier, said endless conveying means and said image carrier forming said nip for image transfer when in contact with each other.

15. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for causing, depending on an image forming mode selected, said charge applying means to apply a charge of a same polarity as a charge assigned to transfer the toner image to the image transfer medium on said endless conveying means while the image transfer medium is absent from a nip formed by said conveying means and said image carrier contacting each other, the image transfer medium being absent from said nip for a period from a time when said image transfer medium, carrying the toner image on one side thereof, moves away from said nip to a time when said image transfer medium arrives at said nip for an image transfer to the other side thereof.

16. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for causing, depending on an image forming mode selected, said charge applying means to apply a charge of a same polarity as a charge assigned to transfer the toner image to the image transfer medium on said endless conveying means while the toner image formed on said image carrier is absent from a nip formed by said conveying means and said image carrier contacting each other, the image transfer medium being absent from said nip for a period from a time when the image transfer medium, carrying the toner image on one side thereof, moves away from said nip to a time when the image transfer medium arrives at said nip for an image transfer to the other side thereof.

17. An image forming apparatus comprising:

an image carrier for carrying a toner image thereon;

endless conveying means for conveying an image transfer medium and having a medium resistance;

charge applying means for applying a charge to said conveying means in order to transfer the toner image from said image carrier to the image transfer medium; and control means for causing, when the image transfer medium is absent at a nip formed by said conveying means and said image carrier contacting each other, said charge applying means to apply a charge of the same polarity as a charge assigned to image transfer to said conveying means and for changing, depending on an image forming condition, a duration of said charge.

18. An apparatus as claimed in claim 17, wherein said image forming condition comprises a number of times of image formation.

19. An image forming apparatus comprising:

an image carrier for carrying a toner image thereon;

endless conveying means for conveying an image transfer medium and having a medium resistance;

charge applying means for applying a charge to said conveying means in order to transfer the toner image from said image carrier to the image transfer medium; and control means for causing, when the toner image formed on said image carrier is absent at a nip formed by said conveying means and said image carrier contacting each other, said charge applying means to apply a charge of the same polarity as a charge assigned to image transfer to said conveying means and for changing, depending on an image forming condition, a duration of said charge.

20. An apparatus as claimed in claim 19, wherein said image forming condition comprises a number of times of image formation.

21. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for controlling, depending on whether a faulty medium transport condition exists, said charge applying means to apply a charge of a same polarity as a charge assigned to transfer the toner image to the image transfer medium on said conveying means when the image transfer member is absent from a nip formed by said endless conveying means and said image carrier contacting each other.

22. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for causing, during a period from a time when a faulty medium transport condition is removed to a time when an image transfer medium or a toner image arrives at a nip formed by said endless conveying means and said image carrier contacting each other, said charge applying means to apply a charge of a same polarity as a charge assigned to transfer the toner image to the image transfer medium on said conveying means when the image transfer member is absent from said nip.

23. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for controlling, depending on whether a faulty medium transportation condition exists, said charge applying means to apply a charge to a same polarity as a charge assigned to transfer the toner image to the image transfer medium on said conveying means when the toner image formed on said image carrier is absent from a nip formed by said endless conveying means and said image carrier contacting each other.

24. An image forming apparatus, comprising:

an image carrier for carrying a toner image thereon;

endless conveying means for conveying an image transfer medium;

charge applying means for applying a charge to said endless conveying means in order to transfer the toner image from said image carrier to the image transfer medium; and control means for causing, during a period from a time when a faulty medium transport condition is removed to a time when an image transfer medium or a toner image arrives at a nip formed by said endless conveying means and said image carrier contacting each other, said charge applying means to apply a charge or a same polarity as a charge assigned to transfer the toner image to the image transfer medium or said conveying means when the toner image formed on said image carrier is absent from said nip.

* * * * *